United States Patent [19]

Michel

[11] 4,289,394

[45] Sep. 15, 1981

[54] PROCESS AND APPARATUS FOR CONVERGING DEVELOPING VAPORS IN DIAZOCOPY MACHINES

[75] Inventor: Claude Michel, Freulleville, France

[73] Assignee: Rhone-Poulenc Systemes, Creteil, France

[21] Appl. No.: 50,995

[22] Filed: Jun. 22, 1979

[30] Foreign Application Priority Data

Jun. 23, 1978 [FR] France ..... 78 18787

[51] Int. Cl.[3] ..... G03D 7/00

[52] U.S. Cl. ..... 354/299; 354/300; 34/155; 355/27; 430/150

[58] Field of Search ..... 354/299, 300; 34/151, 34/155; 430/150; 355/27

[56] References Cited

U.S. PATENT DOCUMENTS 3,440,944 4/1969 Endermann et al. ..... 34/155
3,534,673 10/1970 Muller ..... 34/151
3,589,810 12/1978 Umahashi et al. ..... 430/150
4,068,249 1/1978 Degenhardt et al. ..... 34/155

FOREIGN PATENT DOCUMENTS 1315673 12/1963 France ..... 354/300
2358686 10/1978 France ..... 354/300
762632 11/1956 United Kingdom ..... 354/300

*Primary Examiner*—L. T. Hix
*Assistant Examiner*—Alan Mathews
*Attorney, Agent, or Firm*—Sherman & Shalloway

[57] ABSTRACT

The invention relates to an improvement in diazocopy development machines. A development chamber is used in which ammonia vapors are generated. A converging system made up of converging walls which accelerate the hot ammonia vapors, without additional means, channels the vapors toward the copy support. Thus, a striking is made of the support with the vapors and the development speed can be significantly increased.

6 Claims, 2 Drawing Figures

PROCESS AND APPARATUS FOR CONVERGING DEVELOPING VAPORS IN DIAZOCOPY MACHINES

BACKGROUND OF THE INVENTION

1. Field of the Invention

This invention relates to an improvement in the process of development of diazocopies with ammonia vapors or the like. It relates more particularly to a process of development of a copy support coated with a diazo sensitive layer previously exposed through an original in an ultraviolet exposure station, consisting of bringing said copy support in contact with ammonia vapors at a temperature greater than or equal to 55° C.

2. Description of the Prior Art

Processes for the development of diazocopies have been known as dry development processes. Such a process is described, for example, in French patent application Ser. No. 76 21 408 filed July 13, 1976, now French Pat. No. 23 58 686, assigned to La Cellophane and describing an improvement in the prior art consisting particularly in heating the back of the copy to obtain a better development of the latter in contact with ammonia vapors.

Moreover, it is known, in this development process that excess pressure of the ammonia vapors in the development chamber may be created to increase the penetration of the ammonia vapors in the copy and thus accelerate the development of the sensitive layer. This excess pressure is generally created by a pump or a fan. The drawback of this process is that the excess pressure thus created requires control of leaks at the level of the development chamber so that said pressure will continually exist in said development chamber.

To do this, it is necessary to provide additional means that can be large and very costly, given the relative simplicity of printing machines of the usual design. Further, since this excess pressure is exerted by a pump or fan, this creates an additional energy consumption and a higher production cost.

SUMMARY OF THE INVENTION

The process according to the invention avoids these drawbacks. For this purpose, the process according to the invention is characterized in that the ammonia vapors are channeled and accelerated vertically by aerodynamic effect in a converging conduit, said vapors then being directed toward the copy support placed so that the flow of ammonia vapors has a path between perpendicular and tangential lines of the support. The vapor then strikes the copy support, on its sensitive layer side, with sufficient speed to cause a rapid development of said copy support.

This process is actually particularly simple and does not require any energy consuming apparatus for its embodiment. The invention uses the "chimney or venturi effect" which produces a natural acceleration of the vapors that are concentrated in a converging conduit: the vapors, being hot, undergo a natural acceleration that allows them to strike the copy support and penetrate it, thus accelerating the speed of development of the sensitive layer.

So that the ammonia vapors will reach the copy support with a sufficient speed, the angle of incidence of the vapors on said support is preferably less than 45° and, more preferably 30°, so that a turbulence in the ammonia vapors close to the copy is also obtained.

The invention also relates to a device for using this process. The device comprises a development chamber in which the ammonia vapors are generated by any conventional system and a rotary chamber guiding the sensitive layer of the copy in contact with the ammonia vapors. The device is characterized in that the development chamber is comprised of a converging structure to accelerate the ammonia vapors and concentrate the vapors on the sensitive layer of the copy. The converging system does not require or employ any means of addition of external energy. The converging system of the preferred embodiment is a set of plates assembled together and exhibiting an upper opening and lower opening, one dimension at least being identical for each of the plates; A section of the plates in a vertical plane perpendicular to the copy support exhibits an upper opening smaller in size than that of the lower opening.

Preferably, the converging system is comprised of two converging walls approximately parallel to the rotary cylinder, extending over the entire width of the development chamber, the lower ends of each of the walls being placed on both sides of the receptacle to channel the released vapors, while the upper ends of the walls are located close to the rotary cylinder, the distance separating the bases of the walls being greater than the distance separating the summit of the walls.

To assure a good efficiency to said system, i.e., not to brake the ascent of the ammonia vapors, it is important that the walls, which can be made up of successive planes inclined toward one another, not exhibit any sharp angle that could reflect part of the vapors.

BRIEF DESCRIPTION OF THE DRAWING

The invention will be better understood from the following example of embodiment given by way of non-limiting illustration, with the accompanying.

DETAILED DESCRIPTION OF THE INVENTION

Figure 1:
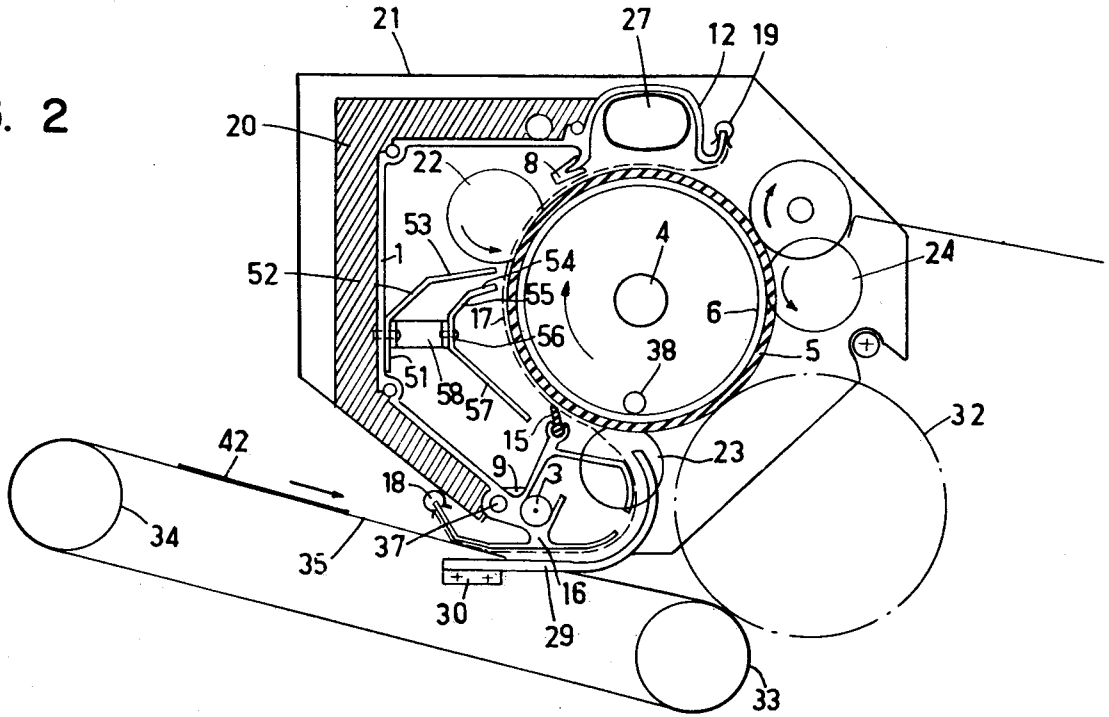
FIG. 1 showing a section of the developer according to the invention.

The development device comprises two side members 21 forming supports between which is development chamber 1 whose bottom forms a horizontal receptacle 9 on the side of which is fastened heating resistance 3. Cylinder 6 which is a metal tube, for example, comprises along its axis a heating resistance element 4. It is equipped with a coating 5 which is in contact with perforated wall 17 fastened at 18 and 19 by any known means. Fluid tightness of development chamber 1 is assured by lip joints 8 and 15. Upper part 12 of development chamber 1 comprises an opening 27 provided with an edge on which are fastened evacuation conduits.

Photosensitive material 42 to be developed is introduced into the development device by a set of parallel belts 35 driven by rollers 33 and 34, the belts having a width of about 5 cm. These belts are separated from one another by a few millimeters so that teeth 29 having a semicircular end can be placed between them to form a comb. The teeth 29 are fastened to support 30. The plane part of these teeth 29 is under upper guide 16 for guiding and introducing of the photosensitive material 42. The semicircular part of these teeth permits the photosensitive material to be reversed or turned over before it is introduced into the development chamber.

Cylinder 6 comprises a toothed edge at each of its ends. Each edge is carried by three rollers 22, 23, and 24. Cylinder 6 is driven by pinion 32 directly connected to a motor shaft not shown in the drawing.

A power supply and thermostat 38 are connected in series with resistance element 4. The thermostat 38 is placed in the vicinity of the inside wall of cylinder 6.

Thermostat 37 is connected in series with heating resistance elements 2 and 3 placed respectively near the outlet of development chamber 1 and in the vicinity of horizontal receptacle 9 and introduction guide 16. As shown in the figure, thermostat 37 is placed in the vicinity of resistance element 3 and horizontal receptable 9. To promote regulation of the temperature of development chamber 1, the latter is surrounded by material 20 with thermal insulation. This material can be glass wool, polyurethane foam, expanded polystyrene, etc. Its thickness will be a few centimeters, varying according to the material used. The vapor guiding system according to this invention is made up of a set of rear walls 51, 52 and 53 placed parallel to the axis of rotation of the cylinder 6, and a set of front walls 54, 55, 56 and 57 also placed parallel to cylinder 6.

Figure 2:
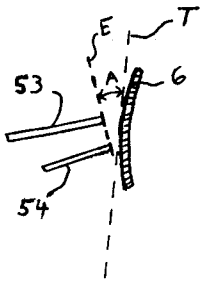
FIG. 2 showing a partial, exploded section of the converging system and cylinder.

The angle of incidence can best be appreciated by referring to the exploded view in FIG. 2. In particular, it can be noted that the angle of incidence A is the angle formed between the line E of the edges of walls 53 and 54 which form the upper opening and the tangential line T along drum 6 at the point of impingement of the vapors. Preferably, walls 53 and 54 are generally parallel to each other as are walls 52 and 55 and walls 51 and 56. Wall 57 is generally parallel to the portion of the development chamber 1 opposing the wall 57. The angles formed between each adjacent wall should be obtuse so that the vapors flow along the converging system and do not reflect from the walls or are otherwise affected by any sharp angles or acute angles which are formed between adjacent walls.

These two sets of walls are connected together by braces such as 58. Three braces are preferable for a developer width of 1.25 m and aluminum walls. The walls are convergent, i.e., walls 53 and 54, in the vicinity of the cylinder are closer than walls 51 and 57 located above horizontal receptacle 9. It has been found that it is not necessary to have a fluid tightness in this convergent system. In particular, wall 57 is some distance (about 1 cm to facilitate fabrication) from joint 15. Because of the suction action of the ammonia vapors by a "chimney or venturi effect," it has been found that few vapors are directed toward the copy support between wall 57 and joint 15. Further, the angles between walls 51, 52 and 53 are obtuse angles, as are those between walls 54, 55, 56 and 57.

Improvement of the development speed can be shown by the following comparative test:

The maximum development speed of a machine is the speed at which an unexposed diazo paper can be developed over a determined length without showing poorly developed zones.

With a REGMA A 130 machine and REGMA 9 N paper, 110 cm wide, a top speed of 350 m/hour for a length of 3 m was obtained.

On this same machine there was installed a converging system as described above, the ammonia vapor flow having an angle of incidence of about 25° in relation to the drive cylinder. There is then obtained for a length of 3 m a top speed of 450 m/hour (all other parameters being equal).

It is contemplated that the process according to the invention applies to all ammonia development machines whether provided with a drive cylinder for the copy support or not: this drive means can be any type without going outside the scope of the invention.

Various changes may be made in the details of the invention, as disclosed, without sacrificing the advantages thereof or departing from the scope of the appended claims. Furthermore, although the present invention has been disclosed and discussed with particular regard to its exceptional advantages in terms of diazocopy machines, it may be understood that the invention may be employed in several applications wherein the concentration of developing vapors would enhance the speed of copying machines.

What is claimed is:

1. An apparatus for developing a copy support coated with a diazo sensitive layer previously exposed through an original in an ultraviolet exposure station, said apparatus comprising:

(a) chamber means for enclosing a developing system;

(b) forming means for forming ammonia vapors within said chamber means;

(c) guide means for guiding and moving the copy support within the chamber means;

(d) converging means for converging the ammonia vapors formed by said forming means onto the copy support as the copy support is moved past the converging means and within the chamber means; and (e) accelerating means for accelerating the ammonia vapors and concentrating the ammonia vapors onto the sensitive layer of the copy, wherein said converging means and accelerating means is a single static converging means applying the ammonia vapors by a venturi effect created by static converging means, said converging and accelerating means not requiring any means of addition of external energy.

2. The apparatus of claim 1 wherein said forming means comprises heating means and means for introducing ammonia solution into the chamber means to be vaporized by said heating means; and wherein the static converging means is comprised of converging walls extending over the entire width of the development chamber, the lower ends of each of said walls being located on both sides of the chamber means to channel the ammonia vapors and the upper ends of said walls located adjacent to said guide means, the distance separating the lower ends of said walls being greater than the distance separating the upper end of said walls, and wherein said guide means includes a rotary cylinder and wherein the upper ends of said converging walls are directed toward the rotary cylinder at an angle of incidence of less than or equal to 45°.

3. The apparatus of claim 2 wherein the converging walls are approximately parallel to the surface of the rotary cylinder.

4. The apparatus of claim 3 wherein each of said walls is comprised of inclined planes, each plane forming an obtuse angle with the plane adjacent thereto.

5. A process for developing a copy support coated with a diazo sensitive layer previously exposed through an original in an ultraviolet exposure station, the process comprising the steps of:

creating ammonia vapors at a temperature equal to or above 55° C.

guiding the copy support within a chamber enclosing the ammonia vapors;

accelerating the vapors upward by an aerodynamic venturi effect, without applying any additional external energy; and converging the ammonia vapors directly onto the copy support with an angle of incidence less than or equal to 45°, whereby the ammonia vapors striking the copy support are in a state of turbulence.

6. The process of claim 5 wherein the angle of incidence is less than or equal to 30°.

* * * * *